United States Patent [19]

Baldwin

[11] 4,387,893

[45] Jun. 14, 1983

[54] ABDOMINAL WEIGHT LIFTING APPARATUS

[75] Inventor: Dan D. Baldwin, Independence, Va.

[73] Assignee: Nautilus Sports/Medical Industries, Inc., Lake Helen, Fla.

[21] Appl. No.: 261,260

[22] Filed: May 6, 1981

[51] Int. Cl.[3] ..... A63B 21/00

[52] U.S. Cl. ..... 272/118; 272/134

[58] Field of Search ..... 272/117, 130, 134, 138, 272/143, 144, 93, DIG. 4, 118

[56] References Cited

U.S. PATENT DOCUMENTS

| | | | |
|---|---|---|---|
| 1,969,901 | 8/1934 | Pilates | 272/134 |
| 3,858,873 | 1/1975 | Jones | 272/117 |
| 4,256,302 | 3/1981 | Keiser et al. | 272/118 |

*Primary Examiner*—Richard C. Pinkham

*Assistant Examiner*—William R. Browne

*Attorney, Agent, or Firm*—Bell, Seltzer, Park & Gibson

[57] ABSTRACT

An exercising apparatus in which the body is supported while being restricted to rotary movement of upper and lower torso portions one relative to the other. Restriction of movement isolates the abdominal muscle group while accomplishing "full range" exercise as herein defined.

The apparatus includes an upper torso engaging backrest and a lower torso engaging backrest and seat so that the user is supported in a generally seated position. Weights and a variable cam provide a variable resistance force to pivotal movement when the upper torso engaging backrest and the lower torso engaging backrest and seat are moved toward and away from each other.

10 Claims, 8 Drawing Figures

ABDOMINAL WEIGHT LIFTING APPARATUS

FIELD AND BACKGROUND OF INVENTION

Exercising undertaken by persons training for athletic events of various types or pursuing a course of treatment for the rehabilitation of an illness, injury or the like has, in recent years, come to involve the use of various apparatus or machines. Such apparatus, machines and methods have grown out of various concepts and studies regarding physiology and physiological development and function.

One type of apparatus and method which has been used with significant success is full range exercise such as is possible, for example, through the use of the apparatus of Jones, U.S. Pat. No. 3,858,873. "Full range" exercise as used with reference to such an apparatus and method, and as used in the description which follows, is a defined term. The defined term "full range exercise" refers to exercise having positive work; negative work; rotary form movement; stretching; prestretching; automatically variable, balanced, direct resistance; resistance in the position of full muscular contraction; and substantially unrestricted speed of movement. The interested reader is referred to available publications for further explication of these characteristic features of full range exercise.

The general field of such exercise and related apparatus and methods is here referred to as "exercise physiology." The field of exercise physiology is related to sports medicine, being the field of medical study which is particularly directed to athletic sports and the like. The development of the field of exercise physiology has involved, among other things, the continuing development of apparatus and methods to accomplish precise application of exercising programs to specific muscles or muscle groups. One such muscle group which has long presented a difficult problem in approaching effective full range exercise is the abdominal muscle group.

BRIEF DESCRIPTION OF INVENTION

It is an object of the present invention to accomplish exercising of abdominal muscles. In realizing this object of the present invention, exercising apparatus is provided and has means for engaging the body of a user. In particular, a user's body is supported in such a manner that the abdominal muscles of a user's body are essentially isolated and are exercised without substantial interaction with other muscle sets.

Yet a further object of the present invention is to accomplish exercising of abdominal muscles of a user by which rotary form movement of a user's torso occurs about an axis extending transversely of the user's body along a line passing through the user's body below and adjacent the sternum, and forward of and adjacent the spine. In accomplishing this object of the present invention, the upper torso and lower torso of the user's body are engaged and are restricted to movement thereof one relative to the other about the defined axis.

BRIEF DESCRIPTION OF DRAWINGS

Some of the objects of the invention having been stated, other objects will appear as the description proceeds, when taken in connection with the accompanying drawings, in which.

DETAILED DESCRIPTION OF INVENTION

While the present invention will be described hereinafter with particular reference to the accompanying drawings, in which an operating embodiment of the apparatus of the present invention is shown, it is to be understood at the outset of the description which follows that it is contemplated that apparatus and methods in accordance with the present invention may be varied from the specific form described hereinafter while still attaining the desired result of this invention. Accordingly, the description which follows is to be understood as a broad teaching disclosure directed to persons of appropriate skill in the appropriate art, and not as limiting upon the scope of this invention.

Referring now more particularly to FIGS. 1 through 6, an apparatus for exercising abdominal muscles in accordance with the present invention is there shown. The apparatus includes a frame structure preferably fabricated from steel tubing and generally indicated at 10. Mounted on the frame are means for supporting a user's body. In the illustrated form of the invention, the means for supporting a user's body includes upper torso engaging means generally indicated at 11 and lower torso engaging means generally indicated at 12.

Figure 8:
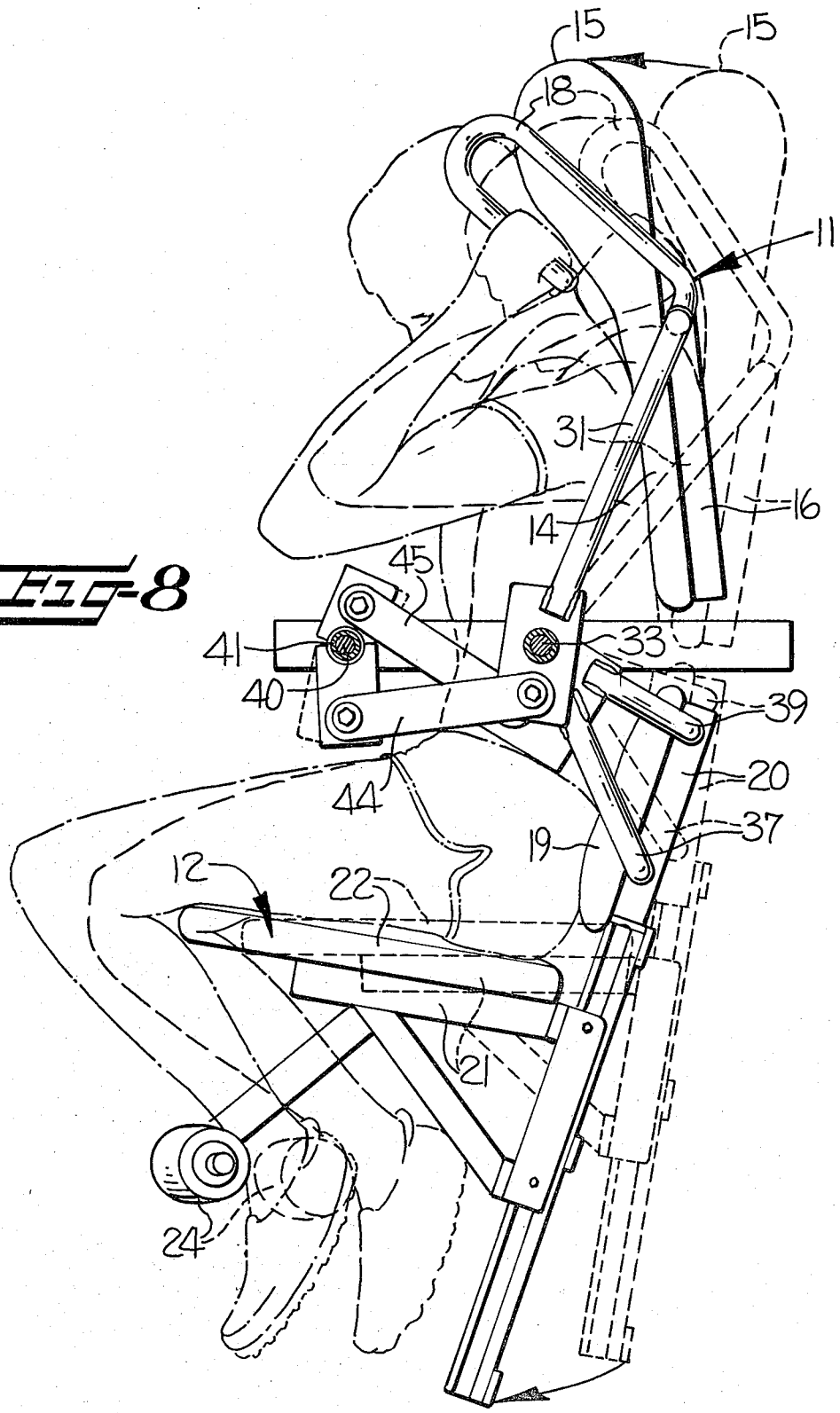
FIG. 8 is a somewhat schematic representation of certain of the elements of the exercise apparatus of FIGS. 1 through 6, illustrating the method of exercise using the apparatus of FIGS. 1 through 6.

The upper torso engaging means, in the form illustrated, includes a backrest cushion (FIGS. 1, 5, 6 and 8) 14 having a rolled portion 15 adjacent the upper end thereof so as to cause a person seated in the apparatus (as described more fully hereinafter) to have their head rolled forwardly (FIG. 8). The cushion 14 is affixed to an upper torso frame 16 which has a pair of hand grips 18 affixed thereto. The lower torso engaging means includes a backrest cushion 19 mounted on a lower torso frame 20. A seat frame generally indicated at 21 and carrying a seat cushion 22 depends from the lower torso frame 20. The seat cushion 22 is provided with a raised central portion 24, so as to cause the legs of a user to be somewhat spread apart during use of the apparatus of the present invention. Positioned beneath the seat cushion 22 are a pair of ankle roll members 24, behind which the feet of a user may be positioned.

Figure 2:
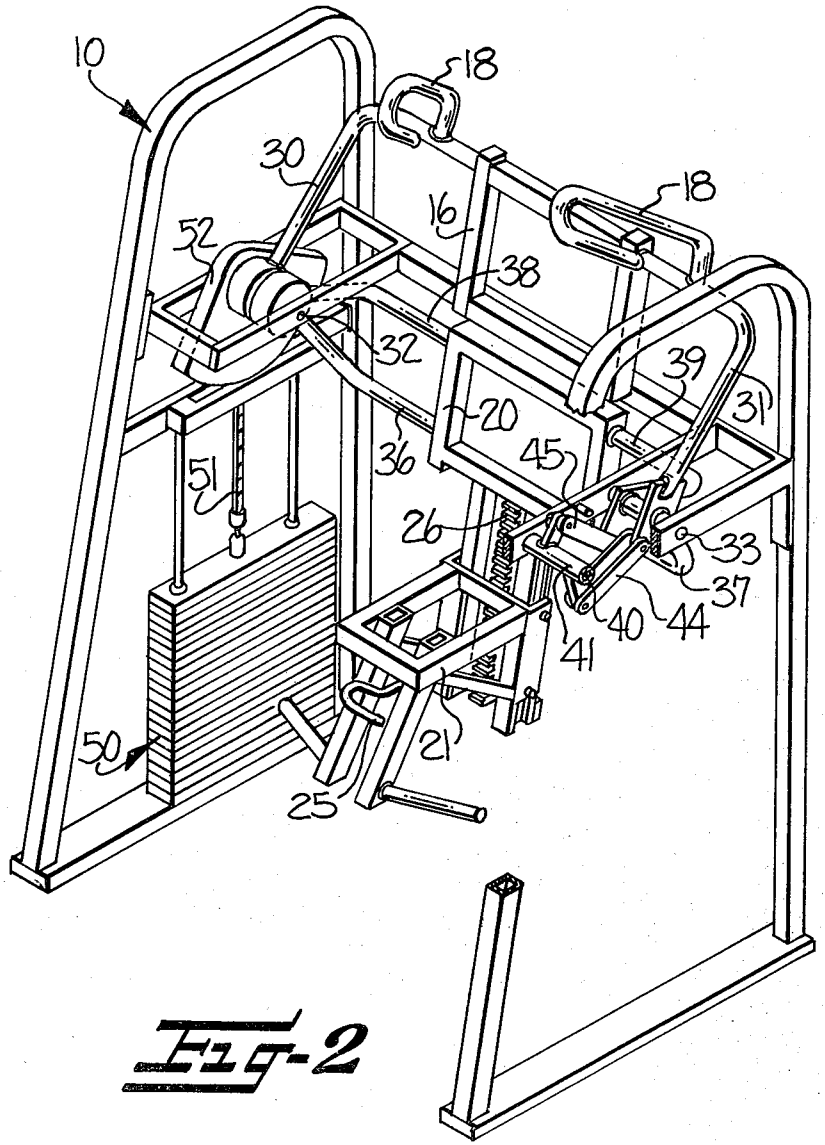
FIG. 2 is a view similar to FIG. 1, taken from a different perspective and showing the apparatus of FIG. 1 with shields and cushions removed.
Figure 1:
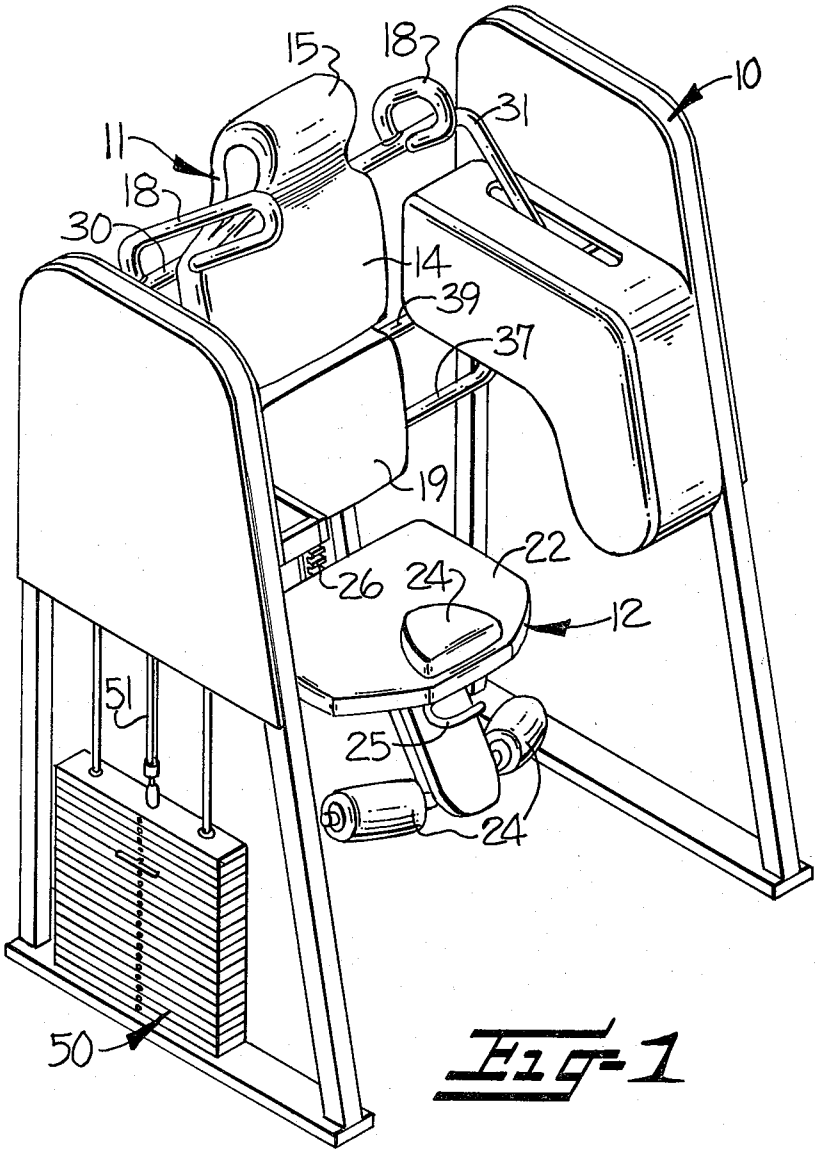
FIG. 1 is a perspective view of an exercise apparatus in accordance with the present invention.
Figure 3:
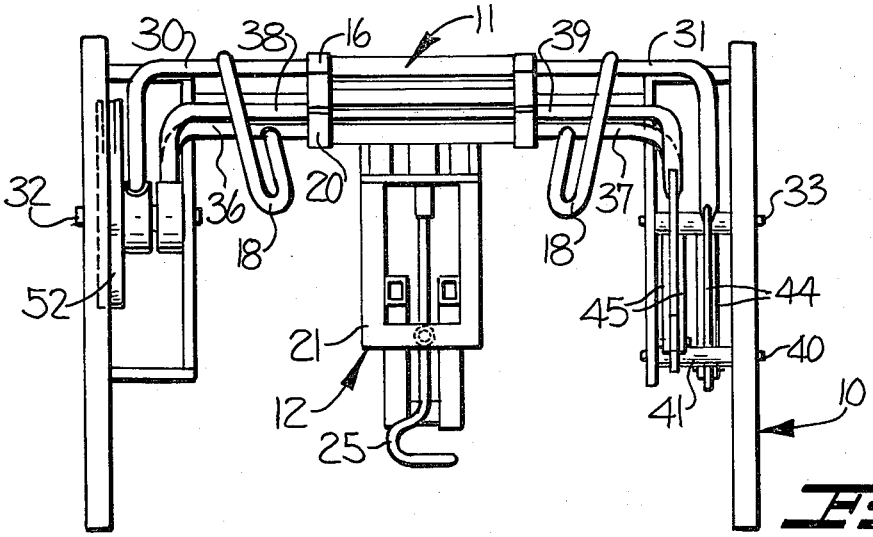
FIG. 3 is a plan view of the apparatus as illustrated in FIG. 2.
Figure 4:
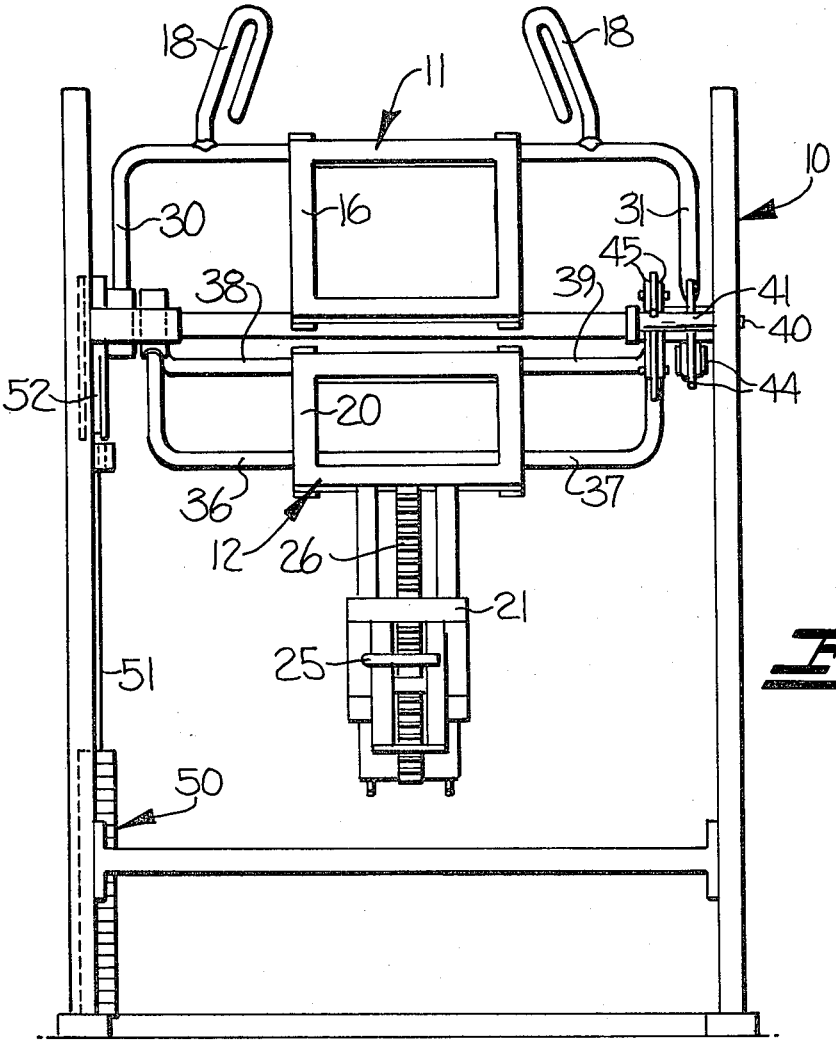
FIG. 4 is a front elevation view of the apparatus as illustrated in FIG. 2.
Figure 5:
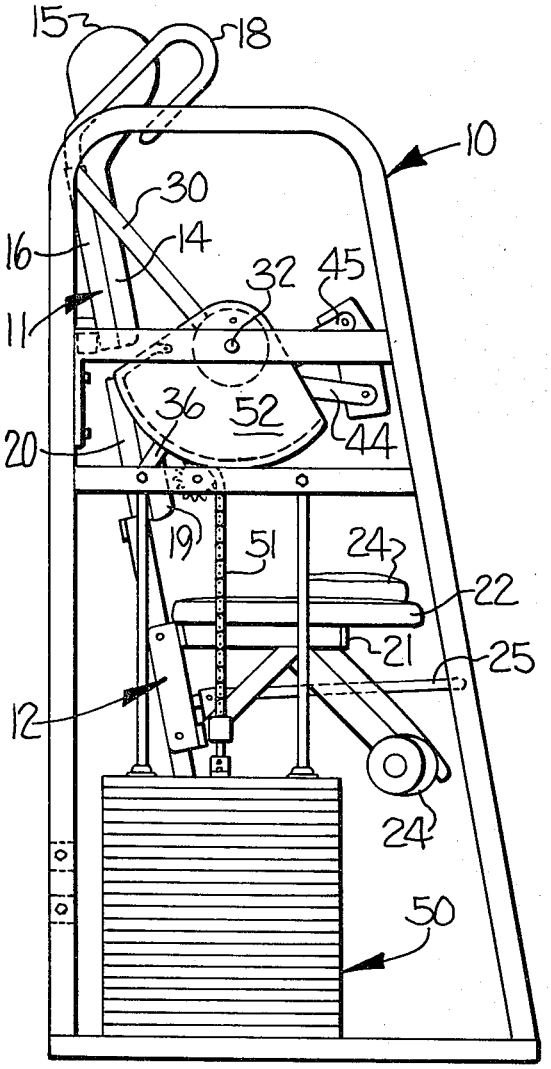
FIG. 5 is a side elevation view of the apparatus of FIG. 1, with a side cover removed to show portions of the operating mechanism of the apparatus.
Figure 6:
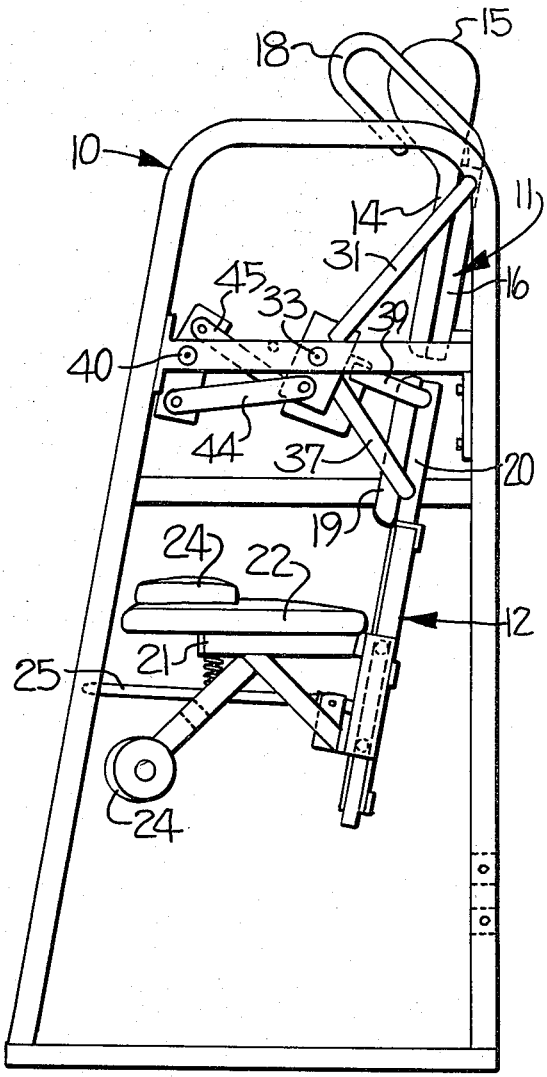
FIG. 6 is a view similar to FIG. 5, from the opposite side of the apparatus of FIG. 1.
Figure 7:
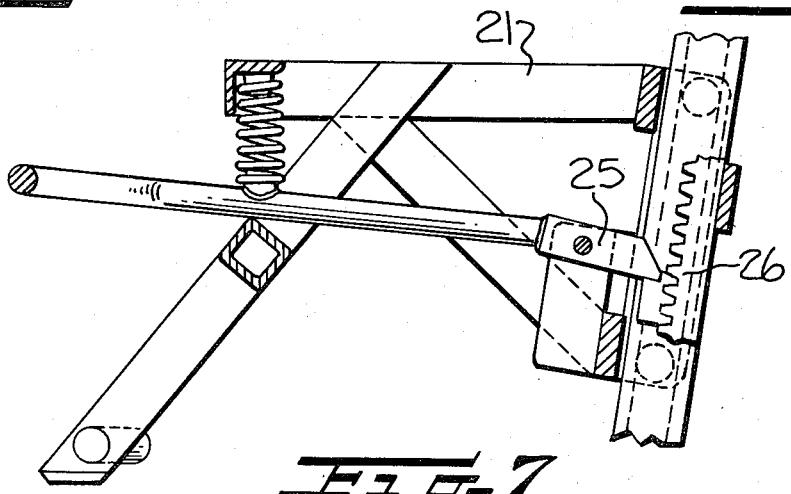
FIG. 7 is an enlarged scale sectional view, illustrating a portion of the apparatus of FIG. 6.

The seat frame 21 is arranged for vertical adjustment relative to the lower torso frame 20, as shown more fully in FIG. 7. More particularly, a latch member 25 engages a rack 26 to retain the seat frame 21 against vertical movement. In order to adjust the seat to an appropriate position as described more fully hereinafter, a forward end of the latch member 25 may be raised as indicated in FIG. 7, withdrawing the latch member from the rack 26 and permitting the seat frame 20 to be moved vertically relative to the lower torso backrest cushion 19.

In accordance with the present invention, means are provided which mount the body supporting means described hereinabove for movement of the upper torso engaging portions and the lower torso engaging portions one relative to the other about a particular axis. As will be noted particularly from FIGS. 2 through 6, the upper torso frame 16 is joined with a pair of arm members 30, 31 mounted for pivotal movement about an axis defined by a pair of coaxially aligned stub shafts 32, 33. By means of a pair of lower arms 36, 37 and a pair of upper arms 38, 39, the lower torso frame 20 is similarly mounted for rotation about the axis defined by the aligned shafts 32, 33. To one side of the apparatus is provided a linkage mechanism which operatively connects the upper torso arms 30, 31 and the lower torso arms 36–39 so that movement of the upper torso engaging means and the lower torso engaging means is coordinated in a particular ratio. The linkage mechanism preferably includes a rock shaft 40 spaced from one stub shaft 33 and on which is rotatably mounted a bell crank 41. An upper torso link member 44 extends between the bell crank 41 and an arm 31 connected with the upper torso frame 16. A lower torso link 45 extends between the bell crank 41 and the arms 37, 39 of the lower torso engaging means. The operation of the linkage is such that rotation of the upper torso engaging means forward and upwardly is coordinated with rotation of the lower torso engaging means downwardly and forwardly. Due to the relative length of the arms, the arcuate path described by the upper torso engaging means is at a greater radius than the arcuate path described by the lower torso engaging means. Further, due to the ratios of the linkage, the lower torso engaging means moves through an arc of approximately two degrees for each three degrees of movement of the upper torso engaging means.

The coaxially aligned stub shafts 32, 33 define an axis of rotation which, during use, extends transversely of the user's body along a line passing through the user's torso. In accordance with the preferred use of the present invention, the seat 22 is adjusted vertically relative to the lower torso back rest 19 so that the body of a user is positioned with the axial line passing through the user's body below and adjacent the sternum and forward of and adjacent the spine. As used with reference to the specific form of this invention here described, "below" refers to displacement in the direction of the feet, and "forward" refers to displacement toward the frontal surface of the body. By such adjustment and cooperation of the user with the apparatus as described to this point, the abdominal muscles of the user's body are essentially isolated so that user produced movement of the upper and lower torso engaging means results solely from contraction and extension of the abdominal muscles.

In accordance with the present invention, resistance means are provided and are operatively connected to the body supporting means for imposing force resisting movement of the upper torso engaging means and the lower torso engaging means one away from the other. In the specific form illustrated, the resistance means includes a weight stack generally indicated at 50. The weight stack is constructed in accordance with known practice so as to permit ready variation in the number of weights to be moved and thus in the force imposed. Force is imposed by the weight stack 50 through a flexible member such as a chain 51. The chain 51 is fixed (FIG. 5), at an end remote from the weight stack 50, to a cam member 52. The cam member 52 is fixed to an adjacent arm 30 of the upper torso engaging means, so as to transmit to the body supporting means force imposed by the action of gravity on the weight stack 50.

As will be appreciated, the movement of the weight stack 50 results in the tensioning of the associated chain 51 to a known, predetermined, and essentially uniform extent. By the provision of the cam member 52, such tension is converted into a torque acting about the axis of movement of the torso engaging means described above. Preferably, the cam member functions as a variation means for varying the force imposed by the resistance means in accommodation of the body part demonstrable force curves achievable by a user of the machine, so as to facilitate full range exercise as mentioned hereinabove.

In use, a user wishing to develop the abdominal muscles may select an appropriate weight to be imposed by the weight stack 50, and assume an exercising position in the apparatus (FIG. 8). As the exercising position is first assumed, the body suppporting means is essentially in a chair-like configuration, so that the abdominal muscles will be generally relaxed. The generally chair-like position is illustrated by phantom lines in FIG. 8. A user would then position the feet rearwardly of the ankle roll members 24, and reach upwardly to grasp the hand grips 18. As so positioned, the muscle systems of the user's body essentially isolate the abdominal muscles. It is contemplated that other bodily positions may similarly isolate the abdominal muscles. Movement of the apparatus is then dependent upon contraction of the abdominal muscles, and subjects those muscles to full range exercise as defined hereinabove.

In the drawings and specification, there has been set forth a preferred embodiment of the invention, and although specific terms are employed, they are used in a generic and descriptive sense only and not for purposes of limitation.

That which is claimed is:

1. Apparatus for exercising abdominal muscles and comprising:

means for supporting a user's body and including upper torso engaging means and lower torso engaging means, means mounting said body supporting means for pivotal movement of said upper torso engaging means and said lower torso engaging means one relative to the other about an axis extending transversely of the user's body along a line passing through the user's body below and adjacent the sternum and forward of and adjacent the spine, and resistance means operatively connected to said body supporting means for imposing force resisting movement to said upper torso engaging means and said lower torso engaging means when one of said upper torso engaging means and said lower torso engaging means moves away from the other, said body supporting means and said mounting means cooperating for isolating the abdominal muscles of the user's body and for exercising such abdominal muscles against the force imposed by said resistance means.

2. Apparatus according to claim 1 wherein said upper torso engaging means comprises a backrest and said lower torso engaging means comprises a backrest and a seat, whereby said body supporting means supports a user's body in a generally seated position.

3. Apparatus according to one of claims 1 or 2 wherein said means mounting said body supporting means comprises upper torso pivot arm means mounted for pivotal movement about said axis and lower torso pivot arm means mounted for pivotal movement about said axis, said arm means cooperating for restricting movement of a user's body during exercise to rotary movement about said axis.

4. Apparatus according to claim 3 wherein said means mounting said body supporting means comprises linkage means operatively connecting said upper torso engaging means and said lower torso engaging means for movement of one of said torso engaging means relative to the other in a defined ratio.

5. Apparatus according to claim 1 wherein said resistance means comprises variation means for changing the amount of force imposed in predetermined relationship to movement of one of said torso engaging means relative to the other.

6. Apparatus for exercising abdominal muscles and comprising:

means for supporting a user's body in a generally seated position and including upper torso engaging means having a backrest portion and lower torso engaging means having a backrest portion and a seat portion, means mounting said body supporting means for coordinated pivotal movement of both of said upper torso engaging means and said lower torso engaging means one relative to the other about an axis extending transversely of the user's body along a line passing through the user's body below and adjacent the sternum and forward of and adjacent the spine, and resistance means operatively connected to said body supporting means for imposing force resisting movement to said upper torso engaging means and said lower torso engaging means when one of said upper torso engaging means and said lower torso engaging means moves away from the other, and including variation means for changing the amount of force imposed in predetermined relationship to movement of said torso engaging means, said body supporting means and said mounting means cooperating for restricting movement of a user's body during exercise to rotary movement about said axis and for isolating the abdominal muscles of the user's body and for exercising such abdominal muscles against the force imposed by said resistance means.

7. Apparatus according to one of claim 5 or 6 wherein said resistance means comprises weight means for imposing a gravitational load and said variation means comprises cam means operatively connected to said weight means for imposing on said torso engaging means torque which is a function of the gravitational load imposed by said weight means.

8. Apparatus according to claim 6 wherein said means mounting said body supporting means comprises upper torso pivot arm means for defining an arcuate path of movement of said upper torso engaging means and lower torso pivot arm means for defining an arcuate path of movement of said lower torso engaging means, said lower torso pivot arm means defining a path along a radius shorter than that of said upper torso pivot arm means.

9. Apparatus according to claim 8 wherein said pivot arm means are mounted for rotation about said axis and further wherein said means mounting said body supporting means comprises linkage means operatively connecting said upper torso pivot arm means and said lower torso pivot arm means for movement of said pivot arm means in a defined ratio of arcs.

10. Apparatus for exercising abdominal muscles and comprising:

means for supporting a user's body in a generally seated position and including upper torso engaging means having a backrest portion and lower torso engaging means having a backrest portion and a seat portion, means mounting said body supporting means for coordinated pivotal movement of both of said upper torso engaging means and said lower torso engaging means one relative to the other about an axis extending transversely of the user's body along a line passing through the user's body below and adjacent the sternum and forward of and adjacent the spine, said mounting means comprising pivot arm means and linkage means joining said pivot arm means for restricting movement of said upper and lower torso engaging means to rotary movement about said axis and to a defined ratio of angular movements, and resistance means operatively connected to said mounting means for imposing force resisting movement to said upper torso engaging means and said lower torso engaging means when one of said upper torso engaging means and said lower torso engaging means moves away from the other and including variation means for changing the amount of force imposed in predetermined relationship to movement to said torso engaging means, said body supporting means and said mounting means cooperating for restricting movement of a user's body during exercise to rotary movement about said axis and for isolating the abdominal muscles of the user's body and for exercising such abdominal muscles against the force imposed by said resistance means.

* * * * *